US005993191A

United States Patent [19]

Lanzl et al.

[11] Patent Number: 5,993,191

[45] Date of Patent: Nov. 30, 1999

[54] HEATER WITH A BURNER WHICH HAS A BINARY NOZZLE

[75] Inventors: Ingrid Lanzl; Christian Hubbauer, both of München; Stefan Ullerich, Stockdorf, all of Germany

[73] Assignee: Webasto Thermosysteme GmbH, Stockdorf, Germany

[21] Appl. No.: 09/199,571

[22] Filed: Nov. 25, 1998

[30] Foreign Application Priority Data

Nov. 26, 1997 [DE] Germany ..... 197 52 293

[51] Int. Cl.[6] ..... F23B 11/04; B60H 1/02; F01D 1/12

[52] U.S. Cl. ..... 431/2; 431/8; 431/10; 431/12; 237/12.3 C; 126/56; 415/55.1

[58] Field of Search ..... 431/12, 2, 10, 431/8, 190; 237/12.3 C; 126/56, 57; 415/55.1; 239/416.4, 416.5, 417.3

[56] References Cited

U.S. PATENT DOCUMENTS

| | | | |
|---|---|---|---|
| 1,101,790 | 6/1914 | Doherty | 126/110 B |
| 1,829,445 | 10/1931 | Haveaux | 431/5 |
| 2,120,387 | 6/1938 | Bargeboer | 239/406 |
| 3,768,920 | 10/1973 | Gerwin | 415/55.1 |
| 3,777,975 | 12/1973 | Kofink | 432/223 |
| 4,105,158 | 8/1978 | Hasebe et al. | 431/184 |
| 4,157,889 | 6/1979 | Bonnel | 431/8 |
| 4,718,602 | 1/1988 | Beck et al. | 126/110 B |

FOREIGN PATENT DOCUMENTS 2 135 093 2/1973 Germany .

*Primary Examiner*—Ira S. Lazarus
*Assistant Examiner*—David Lee
*Attorney, Agent, or Firm*—Sixbey, Friedman, Leedom, Ferguson; David S. Safran

[57] ABSTRACT

A heater, especially a motor vehicle heater which can be operated independently of the engine, with a burner which is supplied with fuel and air via a binary nozzle (2), a combustion chamber (1), and a multistage compressor (3, 4) for compressing the air. The entire mass flow of air necessary for combustion in the combustion chamber (1) is sent to at least one first compressor stage (3) for compression to a first pressure level, and the air mass flow compressed in this way is divided into a first component flow supplied directly to the combustion chamber (1), and a second component flow which is compressed in at least one second compressor stage (4) to a second pressure level and sent to the binary nozzle (2) as the fuel atomization air mass flow.

7 Claims, 1 Drawing Sheet

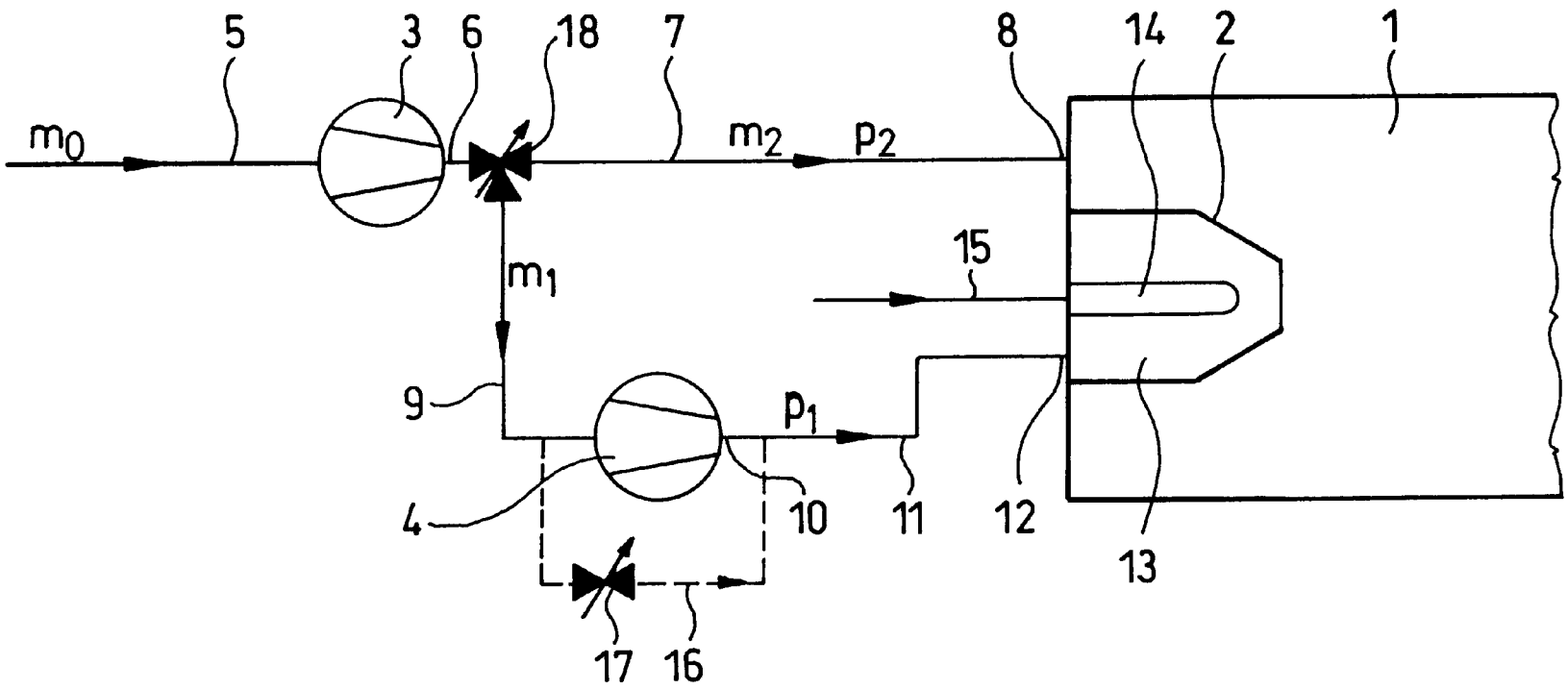
1
2
14
13
8
12
15
11
p2
p1
10
m2
7
16
17
18
m1
6
3
9
4
5
m0

HEATER WITH A BURNER WHICH HAS A BINARY NOZZLE

BACKGROUND OF THE INVENTION

1. Field of the Invention

The invention relates to a heater, especially a motor vehicle heater which can be operated independently of the engine, with a burner which is supplied with fuel and air via a binary nozzle, a combustion chamber, and a multistage compressor for compressing the air.

2. Description of Related Art

Binary nozzles usually have a concentric arrangement of a hole and an annular chamber, either the hole or the annular chamber being supplied with fuel by means of a metering pump and the fuel being atomized by the mass flow of air which is supplied via the other nozzle passage opening, the annular channel or the hole.

Furthermore, it is known, from published German Patent Application 2 135 093 and its counterpart U.S. Pat. No. 3,768,920, that the entire mass flow of air necessary for combustion in the heater is compressed by a two-stage flow machine and is delivered via a nozzle into the combustion chamber. The disadvantage here is that, for a large volumetric flow, a high pressure is necessary which causes correspondingly high energy consumption. The associated high flow speed in a binary nozzle would lead to starting problems, loud noise and high pressure losses.

Moreover, one such heater is known with a burner which has a binary nozzle in which the fuel atomization-air mass flow is compressed via a volumetric compressor to a higher pressure level separately from the other mass flow of air necessary for combustion. Here, the disadvantage is high costs, fault susceptibility, the corresponding maintenance cost of the compressor, and the loud noise of the compressor.

SUMMARY OF THE INVENTION

In view of the nature of the prior art, a primary object of the present invention is to provide a heater, especially a motor vehicle heater which can be operated independently of the engine, with a burner which is supplied with fuel and air via a binary nozzle, a combustion chamber and with a multistage compressor for compressing the air, which is economical, quiet and reliable.

This object is achieved by the entire mass flow of air necessary for combustion in the combustion chamber being sent to at least one first compressor stage for compression to a first pressure level, and the air mass flow compressed in this way, being divided into a secondary air component flow supplied directly to the combustion chamber and a primary air component flow which is compressed in at least one second compressor stage to a second pressure level and is sent to the binary nozzle as the fuel atomization air mass flow.

In other words, the invention calls for air conduction of the burner which has a binary nozzle in conjunction with a multistage compressor in which, in the first stage, the entire mass flow of air necessary for combustion is compressed to a lower pressure level, whereupon this mass flow of air is divided, and one portion of the flow is supplied to the combustion chamber directly and the other portion of the flow, after additional compression, is delivered to the binary nozzle as the atomization air mass flow. The air conduction of the burner, in accordance with the invention, enables matching of the atomization air flow to the respective nozzle requirements without the amount of air necessary for combustion being influenced in this way. Since, with the invention, not all of the mass flow of air is raised to a high pressure level, but only that part of it which is used to atomize the fuel in the binary nozzle, less energy is needed than in the aforementioned prior art. In this way, high starting reliability can be achieved. In addition, the heater of the invention has improved air conduction as compared to the above described prior art which requires a compressor, as well as favorable production costs, and the absence of maintenance above and beyond the engine service life. In contrast to volumetric compression in the prior art, in a compressor with operation associated with loud noise, the air conduction of the invention is characterized by low noise.

Furthermore, it is advantageous that all compressor stages are located on a single engine shaft and can operate with the same rpm.

According to the respective requirements, a single compressor stage is necessary for pre-compression of the entire mass flow of air. Alternatively, several compressor stages can be used for this purpose. The same applies to the re-compression for the partial flow used as the fuel atomization air mass flow.

To optimize triggering of the burner, furthermore, it is advantageously provided that a bypass line be connected parallel to the second compressor stage.

The multistage compressor is preferably a multistage fan, for example, a correspondingly designed annular channel fan.

In the following, the invention is explained in detail relative to a single embodiment with reference to the accompanying drawings.

BRIEF DESCRIPTION OF THE DRAWINGS

The sole FIGURE schematically shows the flow routing in front of the burner of a heater in accordance with the invention.

DETAILED DESCRIPTION OF THE INVENTION

Of the heater in accordance with the invention, the FIGURE shows only the combustion chamber 1, the binary nozzle 2 of the burner which projects into the combustion chamber 1, and a two-stage compressor in the form of a fan with a first fan stage 3 and a second fan stage 4.

The entire air mass flow $m_0$ necessary for combustion in the combustion chamber 1 is supplied to the first fan stage 3, as shown schematically by an air supply line 5. In the first fan stage 3, the air mass flow is compressed to a first, relatively low pressure level $p_2$, and this compressed air mass flow is divided following the output 6 of the first fan stage 3 into two component flows, of which a secondary air component flow $m_2$ is supplied directly via a line 7 to the combustion chamber 1, therefore without being supplied via the bypass to the binary nozzle 2. For this reason, the line 7 is connected to an inlet 8 of the combustion chamber in the area of the binary nozzle 2. A primary air component flow $m_1$ of the air mass flow $m_0$ which is compressed or pre-compressed in the first fan stage 3 is supplied via a line 9 to the second fan stage 4. The second fan stage 4 is used for re-compression of the primary air component flow $m_1$ to a pressure level $p_1$ that is higher than the pressure level $p_2$ of the secondary component flow $m_2$ which is supplied directly to the combustion chamber 1. The recompressed primary air component flow $m_1$, adjacent to the output 10 of the second fan stage 4, is supplied via a line 11 to an atomization connection 12 of the binary nozzle 2. In the embodiment shown, the atomization connection 12 empties into an annular channel 13 of the binary nozzle 2 which concentrically surrounds a nozzle hole 14 which is connected to a fuel feed line 15.

Furthermore, there is a bypass line 16, which is shown by a broken line in the FIGURE, and which is connected in parallel to the second fan stage 4, and thus, the line 9 at the input of the second fan stage 4 can be connected to a controllable degree to the line 11 at the output 10 of the second fan stage by means of a control valve 17 in the bypass line 16. Thus, the proportion of highly compressed primary air can be adapted to the respective operating conditions controlling the amount of air allowed to bypass the second fan stage 4. In particular, a reduction in the start phase can be accomplished. The bypass line 16 can also be replaced by a control valve 18 on the branch point of the line 9 from the line 7 so that the proportion of primary to secondary air can be changed there within certain limits.

Preferably, the first and second fan stages 3 and 4 are located on a common engine shaft and are driven at the same rpm. The proportional division of the precompressed air mass flow leaving the first fan stage 3, or the air mass flow compressed to a first low pressure level into two component flows, takes place via corresponding dimensioning of the two fan stages 3 and 4 or the dimensioning of the binary nozzle 2, and optionally, using the bypass line 16 or control valves 17 and 18. According to the invention, the air conduction of the burner of the heater shown in the FIGURE allows matching of the atomization air flow to the respective nozzle requirements without influencing the total amount of air necessary for combustion. Another advantage is that the air conduction of the invention requires a low energy cost. Maintenance is not necessary during the service life of the engine to drive the two fan stages 3 and 4. The divided two-stage compression of the total air mass flow of the invention leads to less noise than in previous burners.

In a heater with roughly 5 kilowatt heat output, in the first fan stage 3 at full load, an air mass flow $m_0$ of roughly 9.5 $m^3/h$ is compressed to a pressure $p_2$ of roughly 18 hPa above atmospheric pressure $p_0$. From it, a component flow $m_2$ of roughly 8 to 9 $m^3/h$ is supplied via line 7 directly to the combustion chamber 1 as secondary air. A smaller partial flow $m_1$ of roughly 0.5 to 1.5 $m^3/h$ is further compressed in the second fan stage 4 to a pressure $p_1$ of roughly 70 to 100 hPa and is supplied via the atomization connection 12 to the binary nozzle 2 as the primary or atomization compressed air. The ratio of primary to secondary air is thus between 0.03 and 0.16, preferably 0.07.

We claim:

1. Heater for a motor vehicle comprising a burner which is supplied with fuel and air via a binary nozzle, and a combustion chamber, with a multistage compressor for compressing the air, and an intake for an entire mass flow of air necessary for combustion in the combustion chamber; wherein said intake is connected to at least one first compressor stage for compression to a first pressure level; and wherein a first flow line is provided connecting the at least one first compressor stage to the combustion chamber as a secondary air component flow at said first pressure level; and wherein a second flow line is provided connecting the at least one first pressure stage to at least one second compressor stage for compression of a primary air component of the flow of air to a second pressure level; and where an outlet of said at least one second compressor stage is connected to the binary nozzle for supplying the primary air component to the binary nozzle as a fuel atomization air mass flow.

2. Heater as claimed in claim 1, wherein means are provided for changing a pressure ratio between the secondary air flow component and at least one of the primary air flow component and the entire mass flow of air.

3. Heater as claimed in claim 2, wherein a flow controller is provided for varying the proportion of the primary air component flow.

4. Heater as claimed in claim 3, wherein a bypass line is provided connected in parallel to the second compressor stage; and wherein said flow controller is located in said bypass line.

5. Heater as claimed in claim 3, wherein the flow controller is a control valve located at a branch point of the second flow line for the primary air component flow and the first flow line for secondary air component flow.

6. Heater as claimed in claim 1, wherein a pressure ratio of the second pressure level of the primary air component flow produced by the at least one second compressor stage relative to the first pressure level of the secondary air component flow produced by the at least one first compressor stage is from 0.03 to 0.16.

7. Heater as claimed in claim 1, wherein a pressure ratio of the second pressure level of the primary air component flow produced by the at least one second compressor stage relative to the first pressure level of the secondary air component flow produced by the at least one first compressor stage is 0.07.

* * * * *